US010529311B2

(12) United States Patent
Tanoue

(10) Patent No.: US 10,529,311 B2
(45) Date of Patent: Jan. 7, 2020

(54) KEYBOARD APPARATUS AND FRAME

(71) Applicant: YAMAHA CORPORATION, Hamamatsu-shi (JP)

(72) Inventor: Michiko Tanoue, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/918,252

(22) Filed: Mar. 12, 2018

(65) Prior Publication Data

US 2018/0286367 A1 Oct. 4, 2018

(30) Foreign Application Priority Data

Apr. 4, 2017 (JP) ..... 2017-074847

(51) Int. Cl.
*G10H 1/34* (2006.01)
*G10H 1/00* (2006.01)

(52) U.S. Cl.
CPC ..... *G10H 1/344* (2013.01); *G10H 1/0008* (2013.01)

(58) Field of Classification Search
CPC ..... G10H 1/344; G10H 1/34; G10H 1/32
USPC ..... 84/644, 615, 670, 718, 743, 744, 745
See application file for complete search history.

(56) References Cited

U.S. PATENT DOCUMENTS 2,228,141 A * 1/1941 Magnante ..... G10D 11/02 84/376 K
2,612,812 A * 10/1952 Swanson ..... G10B 3/12 84/423 R
3,499,971 A * 3/1970 Ohno ..... G10H 1/055 84/433
3,835,235 A * 9/1974 Amano ..... G10H 1/344 84/433
4,299,155 A * 11/1981 Kumano ..... G10C 3/12 84/177
4,510,839 A * 4/1985 Kumano ..... G10H 1/344 84/434
5,861,566 A * 1/1999 Kaneko ..... G10F 1/02 84/13
5,955,690 A * 9/1999 Yoshinaga ..... G10H 1/344 84/423 R
7,514,613 B2 * 4/2009 Yamaguchi ..... G10C 3/12 84/236
2007/0017339 A1 * 1/2007 Nishida ..... G10C 3/12 84/423 R
2007/0017341 A1 * 1/2007 Nishida ..... G10C 3/12 84/423 R (Continued)

FOREIGN PATENT DOCUMENTS

JP 2013145275 A 7/2013

*Primary Examiner* — David S Warren
(74) *Attorney, Agent, or Firm* — Rossi, Kimms & McDowell LLP

(57) ABSTRACT

A keyboard apparatus includes a frame including a first contacting portion, a second contacting portion, and a first rib, a first member having a first side and a second side opposite to the first side and being attached to the frame, and a plurality of keys being attached to the frame, the first contacting portion being in contact with the first member from the first side, the second contacting portion being in contact with the first member from the second side, the first rib having longitudinal shape in a first direction, and the first contacting portion in the first direction with respect to the first rib.

16 Claims, 14 Drawing Sheets

(56) References Cited

U.S. PATENT DOCUMENTS

| | | | | |
|---|---|---|---|---|
| 2007/0017342 | A1* | 1/2007 | Nishida | G10C 3/12 84/423 R |
| 2007/0017343 | A1* | 1/2007 | Nishida | G10C 3/12 84/423 R |
| 2007/0017356 | A1* | 1/2007 | Nishida | G10H 1/346 84/744 |
| 2008/0072747 | A1* | 3/2008 | Nishida | G10H 1/32 84/744 |
| 2009/0078107 | A1* | 3/2009 | Osuga | G10C 3/12 84/423 R |
| 2010/0071531 | A1* | 3/2010 | Kitajima | G10C 3/12 84/423 R |
| 2010/0071532 | A1* | 3/2010 | Kitajima | G10H 1/346 84/432 |
| 2010/0071533 | A1* | 3/2010 | Suzuki | G10H 1/32 84/439 |
| 2010/0071534 | A1* | 3/2010 | Kitajima | G10H 1/346 84/439 |
| 2013/0180390 | A1 | 7/2013 | Ishida | |
| 2018/0286367 | A1* | 10/2018 | Tanoue | G10H 1/344 |
| 2018/0286368 | A1* | 10/2018 | Tanoue | G10H 1/344 |
| 2019/0012991 | A1* | 1/2019 | Ichiki | G10H 1/34 |
| 2019/0012992 | A1* | 1/2019 | Ichiki | G10B 3/12 |
| 2019/0012996 | A1* | 1/2019 | Ichiki | G10B 3/12 |
| 2019/0027121 | A1* | 1/2019 | Ichiki | G10C 3/12 |
| 2019/0035371 | A1* | 1/2019 | Ichiki | G10B 3/12 |
| 2019/0043459 | A1* | 2/2019 | Ichiki | G10C 3/12 |
| 2019/0043463 | A1* | 2/2019 | Ichiki | G10B 3/12 |
| 2019/0156803 | A1* | 5/2019 | Ogawa | G10C 5/10 |
| 2019/0156804 | A1* | 5/2019 | Ogawa | G10H 1/34 |
| 2019/0156805 | A1* | 5/2019 | Ogawa | G10B 3/12 |
| 2019/0206378 | A1* | 7/2019 | Ichiki | G10C 3/12 |
| 2019/0251939 | A1* | 8/2019 | Ichiki | G10B 3/12 |

* cited by examiner

KEYBOARD APPARATUS AND FRAME

CROSS REFERENCE TO RELATED APPLICATIONS

This application is based upon and claims the benefit of priority from the prior Japanese Patent Application No. 2017-074847 filed on Apr. 4, 2017, the entire contents of which are incorporated herein by reference.

FIELD

The present invention relates to a keyboard apparatus and a frame.

BACKGROUND

An electronic musical instrument generally includes an operator device (e.g., key for specifying a pitch at which to output sound, push button for selecting a tone, etc.) which is push operated. A key switch includes a rubber switch and a switch substrate arranged below the rubber switch. The rubber switch is provided for every key. The rubber switch includes a movable contact portion. A sensor is provided on the switch substrate for every key. When the rubber switch is pressed with a hammer in response to a key depression operation, the movable contact portion is in contact with the sensor of the switch substrate. The operation of the key is thereby detected, and a signal corresponding to the detected content is output.

For example, Japanese Unexamined Patent Publication No. 2013-145275 discloses a keyboard apparatus including a hammer supporting portion and a hammer support (hereinafter also referred to as frame). The hammer supporting portion supports a plurality of hammers which are rotated in response to the key depression operation. A key switch including a plurality of switches pressed with the rotating hammer is attached to the hammer support. The frame is an injection molded article made from synthetic resin. The switch substrate of the key switch is locked in a state inserted between a substrate locking portion and a square wall of the frame.

In the configuration described above, when the switch substrate is arranged on the frame made from synthetic resin, a force is applied in a front and back direction of the frame by the switch substrate. A positioning accuracy of the switch substrate with respect to the front and back direction thereby lowers.

SUMMARY

A keyboard apparatus according to one embodiment of the present invention includes a frame including a first contacting portion, a second contacting portion, and a first rib, a first member having a first side and a second side opposite to the first side and being attached to the frame, and a plurality of keys being attached to the frame, the first contacting portion being in contact with the first member from the first side, the second contacting portion being in contact with the first member from the second side, the first rib having longitudinal shape in a first direction, and the first contacting portion in the first direction with respect to the first rib.

DESCRIPTION OF EMBODIMENTS

Figure 1:
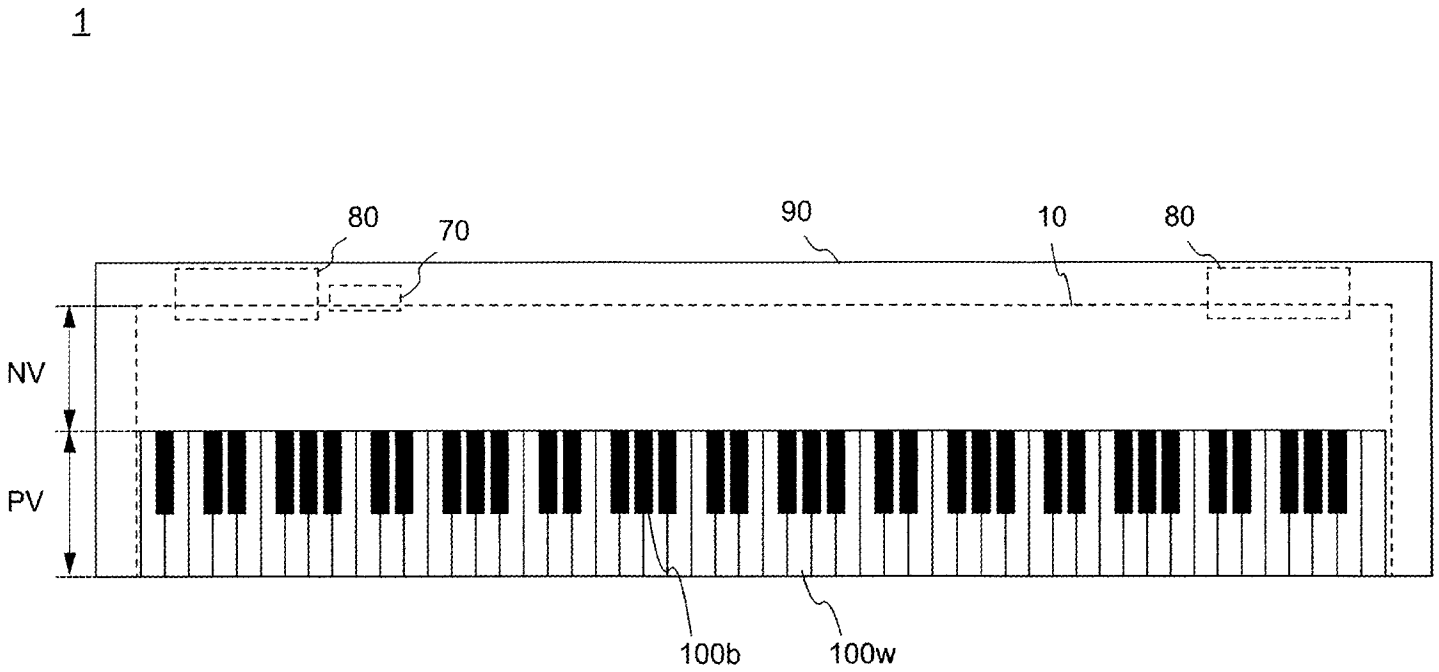
FIG. 1 is a view showing a configuration of a keyboard apparatus according to one embodiment of the present invention.

A keyboard apparatus according to one embodiment of the present invention will be hereinafter described in detail with reference to the drawings. The embodiment described below is an example of the embodiment of the present invention, and the present invention should not be interpreted as being limited to such embodiment. In the figures referenced in the present embodiment, the same reference numeral or similar reference numeral (reference numeral simply added with A, B etc. after the number) are denoted on the same portion or the portion having similar function, and redundant description is sometimes omitted. Furthermore, a dimensional ratio (ratio between each configuration, ratio in longitudinal, lateral and height direction, etc.) of the figure may be different from the actual ratio, or one part of the configuration may be omitted from the figure for the sake of convenience of explanation.

It is one object of one embodiment of the present invention to provide a keyboard apparatus in which a positioning accuracy of the switch substrate with respect to the front and back direction is enhanced.

[Configuration of Keyboard Apparatus]

FIG. 1 is a view showing a configuration of a keyboard apparatus according to one embodiment of the present invention. In this example, a keyboard apparatus 1 is an electronic keyboard that outputs a sound in response to the depression of the key by a user (player) such as an electronic piano. The keyboard apparatus 1 may be a keyboard type controller that outputs control data (e.g., MIDI) for controlling an external sound generating device in response to the depression of the key. In this case, the keyboard apparatus 1 may not include the sound generating device.

The keyboard apparatus 1 includes a keyboard assembly 10. The keyboard assembly 10 includes a white key 100*w* and a black key 100*b*. A plurality of white keys 100*w* and a plurality of black keys 100*b* are arrayed side by side in the keyboard assembly 10. The number of keys 100 is N, and is 88 in this example. A direction in which the plurality of white keys 100*w* and the plurality of black keys 100*b* are arrayed is called a scale direction. When the white key 100*w* and the black key 100*b* do not need to be particularly distinguished, the white key 100*w* and the black key 100*b* are simply referred to as the key 100. In the following description, the configuration with "w" denoted at the end of the reference numeral is the configuration corresponding to the white key. The configuration with "b" denoted at the end of the reference numerals is the configuration corresponding to the black key.

One part of the keyboard assembly 10 exists inside a housing 90. In other words, the housing 90 covers one part of the white key 100*w* and the black key 100*b*. When the keyboard apparatus 1 is seen from above, a portion of the keyboard assembly 10 covered by the housing 90 is referred to as a non-appearing portion NV, and a portion exposed from the housing 90 and visible from the user is referred to as an appearing portion PV. In other words, the appearing portion PV indicates a region constituting one part of the key 100 that can be played and operated by the user. Hereinafter, a portion of the key 100 exposed in the appearing portion PV is sometimes referred to as a key main body portion.

A sound generating device 70 and a speaker 80 are arranged inside the housing 90. The sound generating device 70 generates a sound waveform signal accompanying the depression of the key 100. The speaker 80 outputs the sound waveform signal generated by the sound generating device 70 to an external space. The keyboard apparatus 1 may include a slider for controlling the volume, a switch for switching the tone, a display for displaying various information, and the like.

In the description of the present specification, directions such as up, down, left, right, near, far, and the like are directions of when the keyboard apparatus 1 is seen from the player when playing. For example, the non-appearing portion NV can be expressed as being located on the far side than the appearing portion PV. The direction may be indicated with the key 100 as the reference such as a key front end side (key forward side) and key back end side (key backward side). In this case, the key front end side is the near side seen from the player with respect to the key 100. The key back end side is the far side seen from the player with respect to the key 100. According to the definition described above, in the black key 100*b*, the front end to the back end of the key main body portion of the black key 100*b* can be expressed as being a portion projecting toward the upper side than the white key 100*w*.

Figure 2:
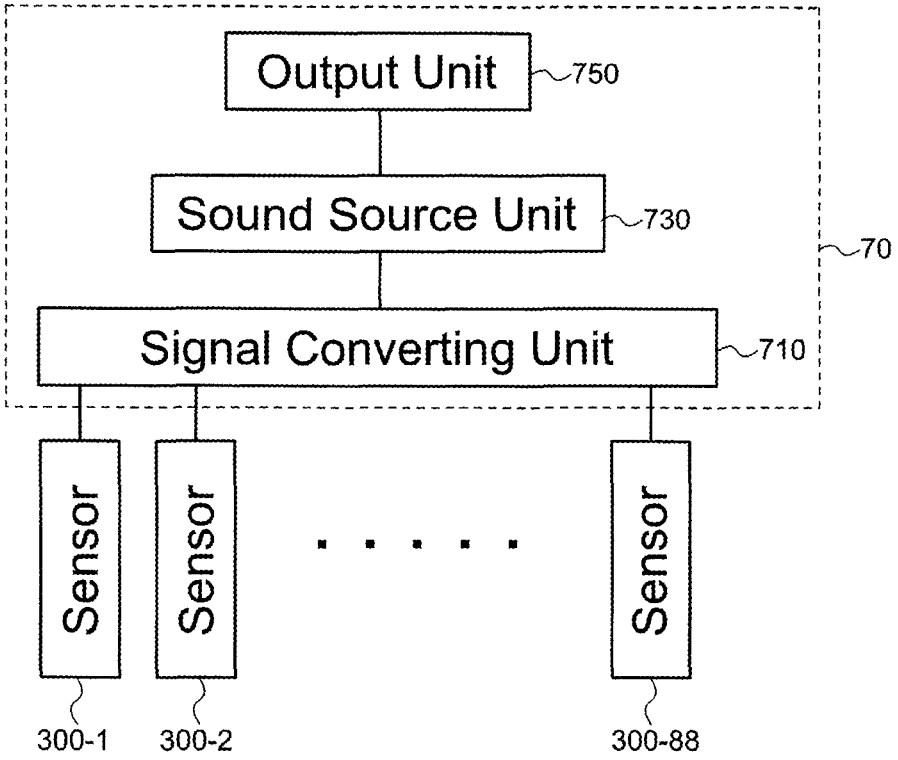
FIG. 2 is a block diagram showing a configuration of a sound generating device according to one embodiment of the present invention.

FIG. 2 is a block diagram showing a configuration of the sound generating device according to one embodiment of the present invention. The sound generating device 70 includes a signal converting unit 710, a sound source unit 730, and an output unit 750. A sensor 300 is arranged in correspondence with each key 100. The sensor 300 detects the operation of the key, and outputs a signal corresponding to the detected content. In this example, the sensor 300 outputs a signal according to a key depression amount of three stages. A key depression speed can be detected according to a time interval of such signals.

The signal converting unit 710 acquires an output signal of the sensor 300 (sensors 300-1, 300-2, . . . , 300-88 corresponding to 88 keys 100), and generates an operation signal corresponding to the operation state in each key 100, and outputs the operation signal. In this example, the operation signal is a signal of MIDI format. The signal converting unit 710 outputs a note ON according to the key depression operation. A key number indicating which one of the 88 keys 100 is operated, and a velocity corresponding to the key depression speed are output in correspondence with the note ON. The signal converting unit 710 corresponds and outputs the key number and a note OFF according to a key releasing operation. A signal corresponding to other operations such as pedal, and the like may be input to the signal converting unit 710, and reflected on the operation signal.

The sound source unit 730 generates the sound waveform signal based on the operation signal output from the signal converting unit 710. The output unit 750 outputs the sound waveform signal generated by the sound source unit 730. The sound waveform signal is, for example, output to the speaker 80, a sound waveform signal output terminal, and the like.

[Configuration of Keyboard Assembly]

Figure 3:
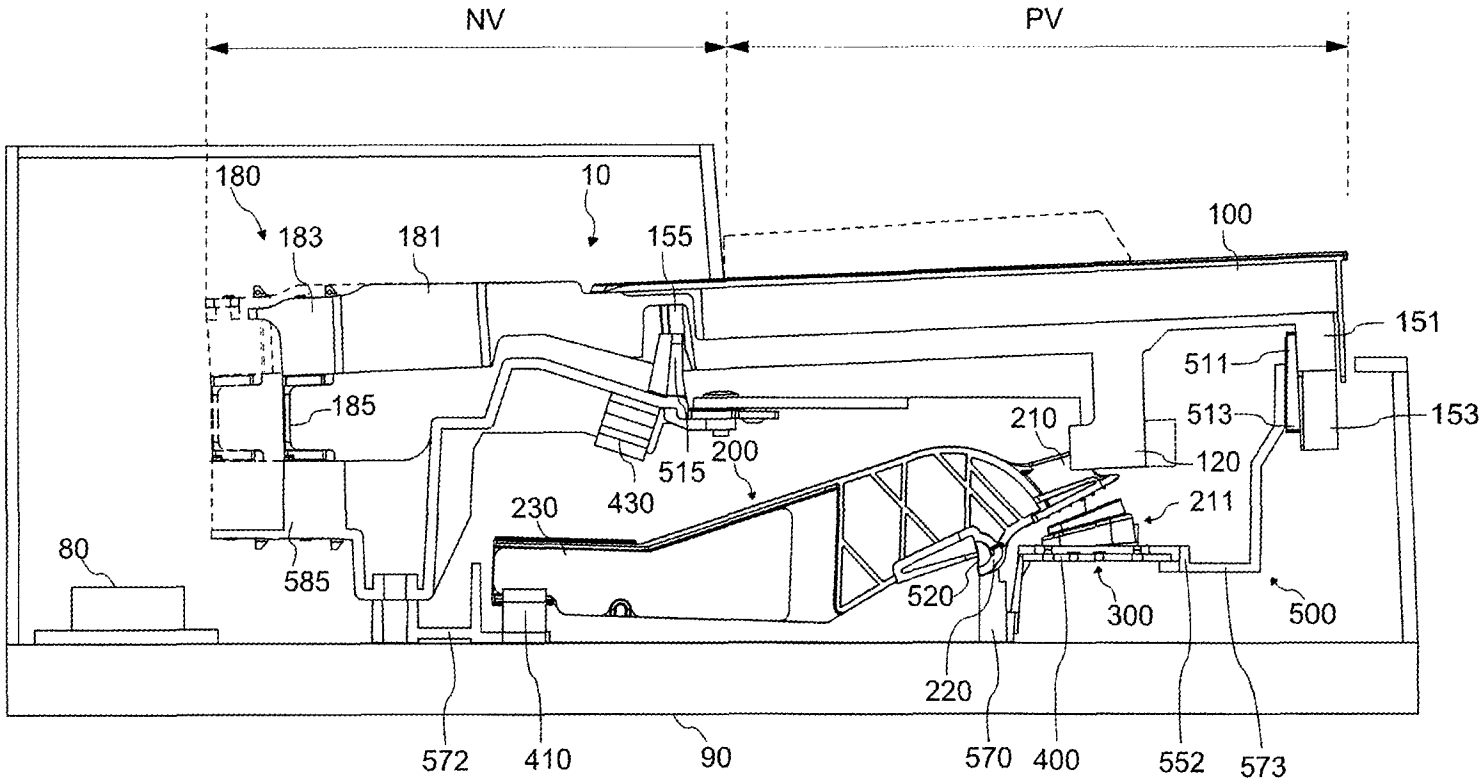
FIG. 3 is a side view showing a configuration of inside the housing according to one embodiment of the present invention.

FIG. 3 is a side view showing a configuration of inside the housing according to one embodiment of the present invention. The white key 100*w* will be described in the following description, but will be simply referred to as the key 100 for the sake of convenience of explanation. As shown in FIG. 3, the keyboard assembly 10 and the speaker 80 are arranged inside the housing 90. The speaker 80 is arranged on the far side of the keyboard assembly 10. The speaker 80 is arranged to output the sound corresponding to the depression of the key toward the upper side and the lower side of the housing 90. The sound output toward the lower side advances toward the outside from the lower surface side of the housing 90. The sound output toward the upper side passes from the inside of the housing 90 through a space inside the keyboard assembly 10, and advances toward the outside from the gap between the adjacent keys 100 in the appearing portion PV or the gap between the key 100 and the housing 90.

The configuration of the keyboard assembly 10 will be described using FIG. 3. In addition to the key 100 described above, the keyboard assembly 10 also includes a connecting portion 180, a hammer assembly 200, and a frame 500. The frame 500 is an injection molded article made of synthetic resin, and is fixed to the housing 90. The connecting portion 180 rotatably connects the key 100 with respect to the frame 500. The connecting portion 180 includes a plate-shaped flexible member 181, a key side supporting portion 183, and a rod shaped flexible member 185. The plate-shaped flexible member 181 is extended from the back end of the key 100 toward the key back end side. The key side supporting portion 183 is extended from the back end of the plate-shaped flexible member 181 toward the key back end side. The rod shaped flexible member 185 is supported by the key side supporting portion 183 and a frame side supporting portion 585 of the frame 500. In other words, the rod shaped flexible member 185 is arranged between the key 100 and the frame 500. The key 100 is rotated with respect to the frame 500 when the rod shaped flexible member 185 is bent. The rod shaped flexible member 185 is removably attached with respect to the key side supporting portion 183 and the frame side supporting portion 585. The keyboard assembly 10 is a structural body made of resin in which the majority of the configuration is manufactured by injection molding, and the like. The rod shaped flexible member 185 may be integral with the key side supporting portion 183 and the frame side supporting portion 585, or may be adhered to the key side supporting portion 183 and the frame side supporting portion 585. That is, the rod shaped flexible member 185 may be configured so as not to be removably attached with respect to the key side supporting portion 183 and the frame side supporting portion 585.

The key 100 includes a key guide 151, a key guide 153, and a side key guide 155. In other words, the key guide 151, the key guide 153, and the side key guide 155 are connected to the key 100. The frame 500 includes a frame guide 511, a frame guide 513, and a side frame guide 515. In other words, the frame guide 511, the frame guide 513, and the side frame guide 515 are connected to the frame 500. The key guide 151 is slidable contact with the frame guide 511. The key guide 153 is slidable contact with the frame guide 513. The side key guide 155 is slidable contact with the side frame guide 515.

The key guide 151 is slidable contact with the frame guide 511 while covering the frame guide 511. In other words, in the scale direction, the key guide 151 is slidable contact with both sides of the frame guide 511 extending from the frame 500 toward the upper side and the key front end side.

The key guide 153 is slidable contact with the frame guide 513 while covering the frame guide 513. In other words, in the scale direction, the key guide 153 is slidable contact with both sides of the frame guide 513 extending from the frame 500 toward the upper side and the key front end side. The key guide 153 is arranged on the lower side than the key guide 151.

The side key guide 155 is slidable contact with the side frame guide 515 while being sandwiched by the side frame guide 515. In other words, in the scale direction, the side key guide 155 is slidable contact with both sides of the side frame guide 515 extending from the frame 500 toward the upper side.

The key guide 151 and the key guide 153 are arranged in a region exposed from the housing 90. The side key guide 155 is arranged in a region covered by the housing 90. That is, the key guide 151 and the key guide 153 are arranged at positions corresponding to the appearing portion PV. The side key guide 155 is arranged in a region corresponding to the non-appearing portion NV. The side key guide 155 exists the key front end side than the connecting portion 180 (plate-shaped flexible member 181). However, the side key guide 155 may be arranged in a region corresponding to the appearing portion PV.

The hammer assembly 200 is rotatably attached to the frame 500. A shaft supporting portion 220 of the hammer assembly 200 and a rotation shaft 520 of the frame 500 are slidable contact with at least three points. A front end 210 of the hammer assembly 200 is in contact with a hammer supporting portion 120 in an internal space of the hammer supporting portion 120. The front end 210 slidably moves in essentially the front and back direction with the hammer supporting portion 120. The slidably moving portion, that is, the portion where the front end 210 and the hammer supporting portion 120 are in contact is located on the lower side of the key 100 in the appearing portion PV (key front end side than back end of key main body portion).

The hammer assembly 200 includes a weight portion 230 made of metal at a far side than the rotation shaft. At a normal time (when key is not depressed), a state in which the weight portion 230 is mounted on a lower stopper 410 is obtained, and the front end 210 of the hammer assembly 200 pushes back the key 100. When the key is depressed, the weight portion 230 is moved upward thus hitting an upper stopper 430. The hammer assembly 200 applies a weight on the player depressing the key by the weight portion 230. The lower stopper 410 and the upper stopper 430 are formed with a shock absorbing material, and the like (non-woven cloth, elastic body, etc.).

The frame 500 includes a circuit substrate 400 (first member), which is a plate-shaped member. The circuit substrate 400 is substantially parallel to a mounting surface of the housing 90 in cross-sectional view. The sensor 300 corresponding to the key 100 is arranged on the circuit substrate 400. A rubber switch 211 is arranged on the circuit substrate 400. The rubber switch 211 is arranged in correspondence with each key 100. The rubber switch 211 has a dome shaped bulging portion formed on a rubber sheet, and a movable contact portion is arranged in such bulging portion. The movable contact portion is arranged facing the sensor 300 at a distance so as to be in contact with or separated from the sensor 300 of the circuit substrate 400. When the bulging portion is pressed by the hammer assembly 200 according to the key depression operation of the key 100, the bulging portion is elastically deformed so that the movable contact portion makes contact with the sensor 300 of the circuit substrate 400. The note ON is thereby output from the signal converting unit 710 shown in FIG. 2.

In the following description, the circuit substrate 400 will be described by way of example for the plate-shaped member, but the present invention is not limited thereto. For example, if the rubber switch does not have a contact portion with respect to the plate-shaped member, and a member corresponding to the rubber switch is a member that only generates a reactive force, the plate-shaped member may be a plate-shaped member used to support the member that generates the reactive force. The plate-shaped member may be a member configuring one part of the frame or may be a different member, and the like. The plate-shaped member may be plastic or may be metal.

Figure 4:
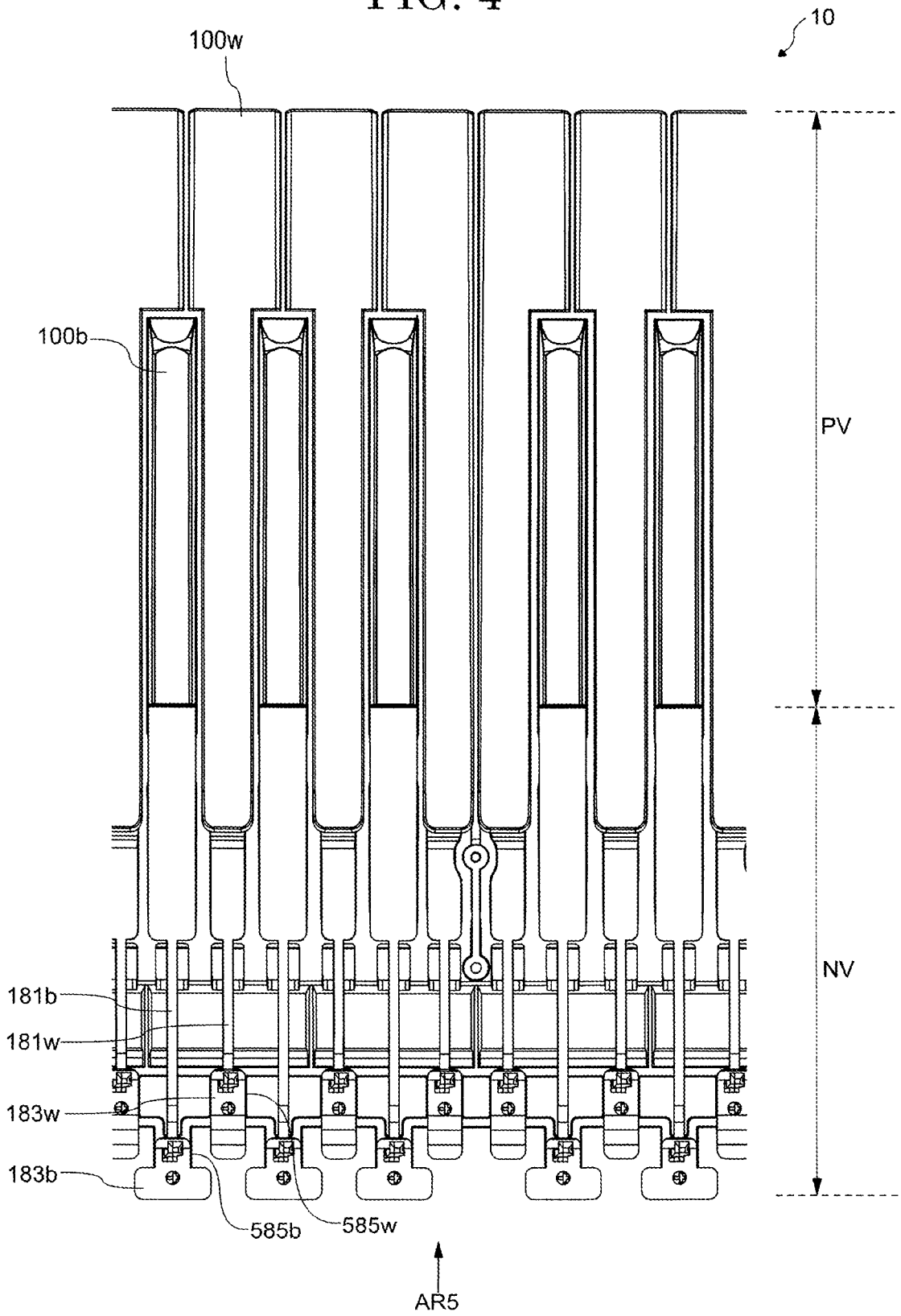
FIG. 4 is a top view showing the keyboard assembly according to one embodiment of the present invention.

FIG. 4 is a top view showing the keyboard assembly according to one embodiment of the present invention. As shown in FIG. 4, the key side supporting portion 183*b* of the black key 100*b* is arranged on the key back end side than the key side supporting portion 183*w* of the white key 100*w*. This position is associated with the positions of the rod shaped flexible members 185*w*, 185*b* that act as the rotation center of the key 100. The difference in the rotation center of the white key and the black key of an acoustic piano can be demonstrated by such arrangement. In this example, the plate-shaped flexible member 181*b* corresponding to the black key 100*b* is longer than the plate-shaped flexible member 181*w* corresponding to the white key 100*w*. In correspondence with such arrangement, the frame side supporting portion 585*b* of the frame 500 is arranged on the key back end side than the frame side supporting portion 585*w*. Thus, the shape of the key back end side (frame side supporting portion 585) of the frame 500 is a shape in which the frame side supporting portion 585*b* is projected toward the far side than the frame side supporting portion 585*w*.

In FIG. 4, one part of the configuration of the hammer assembly 200 and the frame 500 located on the lower side of the key 100 is omitted. Specifically, the configuration (frame side supporting portion 585, etc.) of the frame 500 in the vicinity of the connecting portion 180 is shown, but the configuration of the frame 500 on the near side is omitted. In other explanations as well, one part of the configuration is sometimes omitted in the illustration.

[Structure of Frame]

Figure 5:
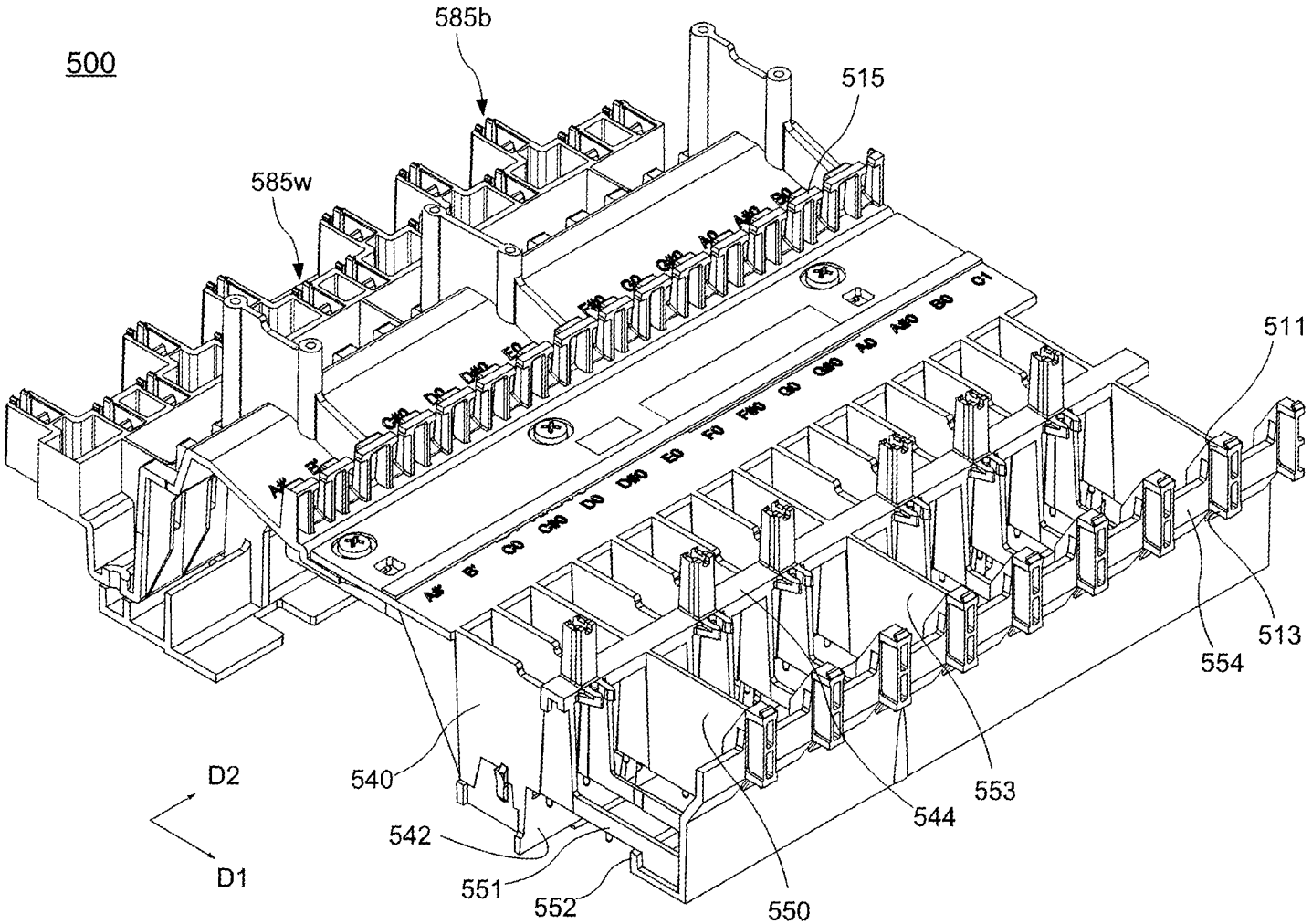
FIG. 5 is a perspective view showing a detailed structure of a frame according to one embodiment of the present invention.

FIG. 5 is a perspective view showing a detailed structure of the frame according to one embodiment of the present invention. FIG. 5 is a perspective view seen from the upper left toward the front surface of the frame 500. The frame 500 includes the frame guide 511, the frame guide 513, and the side frame guide 515. The frame 500 also includes a rib 540, a wall portion 542, a supporting column 544, a rib 550, a rib 551, a wall portion 552, a rib 553, and a wall portion 554. The rib and the wall portion are both plate-shaped members. The rib is extended in a first direction D1, and the wall portion is extended in a second direction D2 intersecting the first direction D1. For example, the rib is a plate-shaped member extending in a direction parallel to the longitudinal direction of the key 100, and the wall portion is a plate-shaped member extending in a direction intersecting the longitudinal direction of the key 100.

The plurality of frame guides 511 and the plurality of frame guides 513 are coupled by the wall portion 554. The frame guide 511 is projected toward the upper side from the wall portion 554. The frame guide 513 is projected toward the key front end side from the wall portion 554. The frame guide 511 and the frame guide 513 are arranged in correspondence with the white key 100*w*. However, the frame guide 511 and the frame guide 513 may be arranged in correspondence with the black key 100*b*.

The side frame guide 515 is arranged between the adjacent keys 100. The side frame guide 515 is in contact with both the white key 100*w* and the black key 100*b* at a position (e.g., between A and B) where the white key 100*w* and the black key 100*b* are adjacent to each other. The side frame guide 515 is in contact with only the white keys 100*w* at a position (e.g., between B and C) where the white keys 100*w* are adjacent to each other. When the side frame guide 515 is arranged between the adjacent keys 100, the adjacent keys 100 can be suppressed from making contact with each other even if the key 100 is moved in the scale direction in the non-appearing portion NV.

The rib 540 is arranged between the adjacently arranged hammer assemblies 200. In other words, the hammer assembly 200 is arranged in a space delimited by the rib 540. The plurality of ribs 540 are coupled by the wall portion 542 (first wall portion) and the supporting column 544. The wall portion 552 (second wall portion) is a plate-shaped member extending in a direction parallel to the wall portion 542. The wall portion 552 is arranged at a position facing the wall portion 542. The wall portion 552 and the wall portion 542 are connected by the ribs 550, 551, and 553. The wall portion 552 is connected to the wall portion 554.

Figure 6:
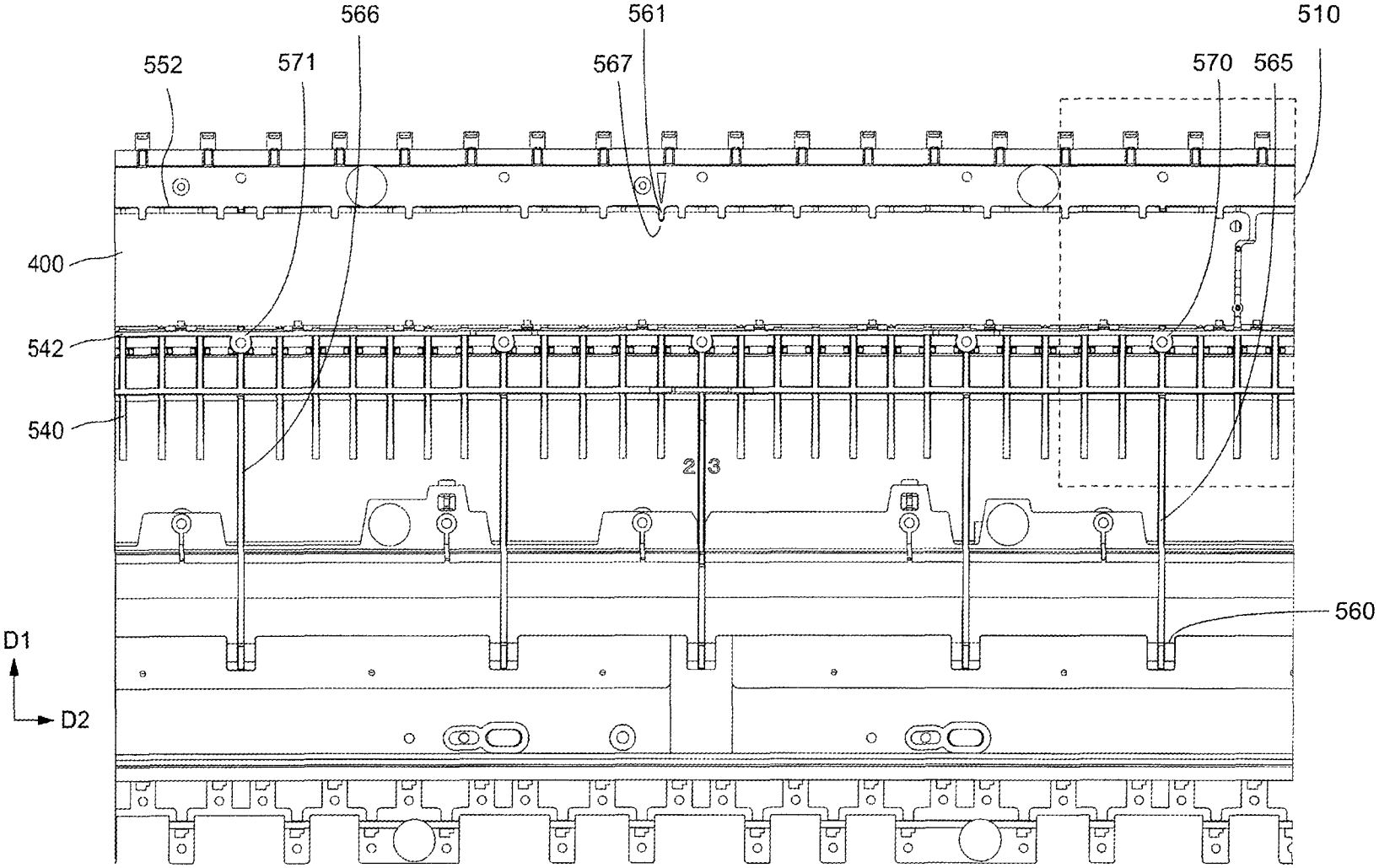
FIG. 6 is a bottom view showing the frame according to one embodiment of the present invention.

FIG. 6 is a view showing a detailed structure of the frame according to one embodiment of the present invention. FIG. 6 is a plan view of the frame 500 seen from below. The frame 500 further includes a rib 565 (first rib), a rib 566 (second rib), and a positioning convex portion 561. The rib 565 and the rib 566 are plate-shaped members extending in a direction parallel to the longitudinal direction of the hammer assembly. The positioning convex portion 561 is arranged on the wall portion 552. The wall portion 542 is a plate-shaped member extending in a direction intersecting the rib 565 and the rib 566. The wall portion 542 couples the rib 565 and the rib 566. In other words, the wall portion 542 is connected to the rib 565 and the rib 566. In the present specification, an example in which the rib 565 and the rib 566 are extended in the first direction D1 is shown, but the present invention is not limited thereto. The rib 565 and the rib 566 may be extended in parallel, or may not be extended in parallel.

The circuit substrate 400 is arranged on the frame 500. A concave portion 567 used for left and right positioning is arranged on the circuit substrate 400. The positioning convex portion 561 arranged on the wall portion 552 has a function of positioning the circuit substrate 400 with respect to the left and right direction. Specifically, the positioning of the circuit substrate 400 with respect to the left and right can be carried out by fitting the concave portion 567 formed on the circuit substrate 400 to the positioning convex portion 561.

The rib 565 and the rib 566 are arranged between the adjacent hammer assemblies. The rib 565 and the rib 566 are coupled by the wall portion 542. The rib 565 is arranged on an extended line in the longitudinal direction of the rib 553 shown in FIG. 5, and the rib 566 is arranged on an extended line in the longitudinal direction of the rib 550 shown in FIG. 5.

Figure 7:
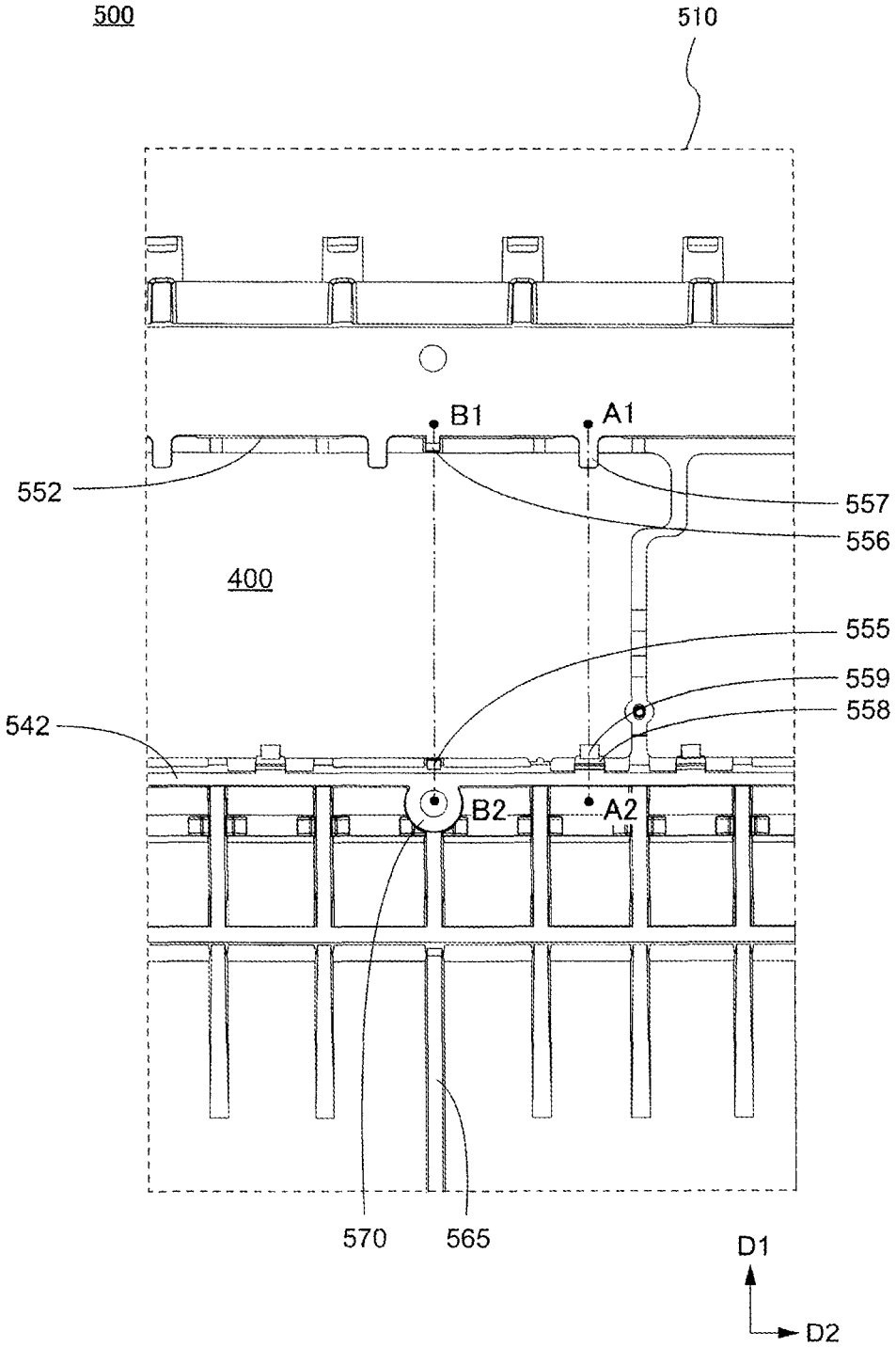
FIG. 7 is a view in which one part of the frame according to one embodiment of the present invention is enlarged.

Next, FIG. 7 shows a view in which one part 510 of the frame 500 shown in FIG. 6 is enlarged. The frame 500 also includes a holding portion 555 (first projecting portion or first contacting portion), a holding portion 556 (second projecting portion or second contacting portion), and the rib 565. At least one of the holding portion 555 and the holding portion 556 is arranged on an extended line in the longitudinal direction of the rib 565. The frame 500 further includes a fixing portion 557 (third projecting portion or third contacting portion), a flexible portion 558 (extending portion), and a locking portion 559 (fourth projecting portion or fourth contacting portion). The holding portion 555 is arranged on the wall portion 542, and is projected from the wall portion 542 toward the wall portion 552. That is, the holding portion 555 has a convex shape. In other words, the holding portion 555 has a component that projects in the opposite direction to the rib 565 with respect to the holding portion 555 in the first direction D1. The holding portion 556 is arranged on the wall portion 552 and is projected from the wall portion 552 toward the wall portion 542. That is, the holding portion 556 has a convex shape. In other words, the holding portion 556 has a component that projects in a direction from the holding portion 556 toward the holding portion 555 in the first direction D1. The holding portion 556 has a component projecting in an opposite direction to the rib 565 with respect to the holding portion 555. The holding portion 555 and the holding portion 556 are respectively in contact with the circuit substrate 400 from sides (or end sides) on opposite sides of the circuit substrate 400. The flexible portion 558 is arranged on the wall portion 542, and the locking portion 559 is connected to the flexible portion 558. The fixing portion 557 is arranged on the wall portion 552. The fixing portion 557 is projected from the wall portion 552 toward the wall portion 542. The circuit substrate 400 is fixed in the front and back direction of the frame 500 by the holding portion 555 and the holding portion 556. The circuit substrate 400 is regulated from moving toward the lower side by the fixing portion 557 and the locking portion 559.

In FIG. 7, an example in which the flexible portion 558 is arranged on the wall portion 542 is shown, but the present invention is not limited thereto. A member on which the flexible portion 558 is arranged may not be in a form of a wall. For example, the flexible portion 558 may be arranged on the rib 540.

In FIG. 7, an example in which the fixing portion 557 is arranged on the wall portion 552 is shown, but the present invention is not limited thereto. A member on which the fixing portion 557 is arranged may not be in a form of a wall. For example, the fixing portion 557 may be arranged on the member 573 shown in FIG. 3.

In FIG. 7, at least one of the holding portion 555 and the holding portion 556 is integrated (integrally molded) with the rib 565. The holding portion 555 is arranged on an extended line in the longitudinal direction (first direction D1) of the rib 565. In other words, the rib 565 is arranged in the first direction D1 with respect to the holding portion 555. The holding portion 556 is arranged on an extended line in the longitudinal direction of the rib 565 and at a position facing the holding portion 555. In other words, the rib 565 is arranged in the first direction D1 with respect to the holding portion 556. In FIG. 7, a configuration in which the holding portion 556 and the holding portion 555 face each other on the extended line in the longitudinal direction of the rib 565 is shown, but the present invention is not limited thereto. At least one of the holding portion 555 and the holding portion 556 merely needs to be arranged on the extended line in the longitudinal direction of the rib 565. If at least one of the holding portion 555 and the holding portion 556 is arranged on the extended line in the longitudinal direction of the rib 565, the positioning of the circuit substrate 400 with respect to the front and back direction can be enhanced after fitting the circuit substrate 400 to the frame 500.

The fixing portion 557 and the flexible portion 558 are arranged at non-overlapping positions on the extended line in the longitudinal direction of the rib 565. The flexible portion 558 is arranged on the wall portion 542. The locking portion 559 is connected to the flexible portion 558. The fixing portion 557 is arranged on the wall portion 552. The fixing portion 557 is arranged at a non-overlapping position on the extended line in the longitudinal direction of the rib 565.

Figure 8:
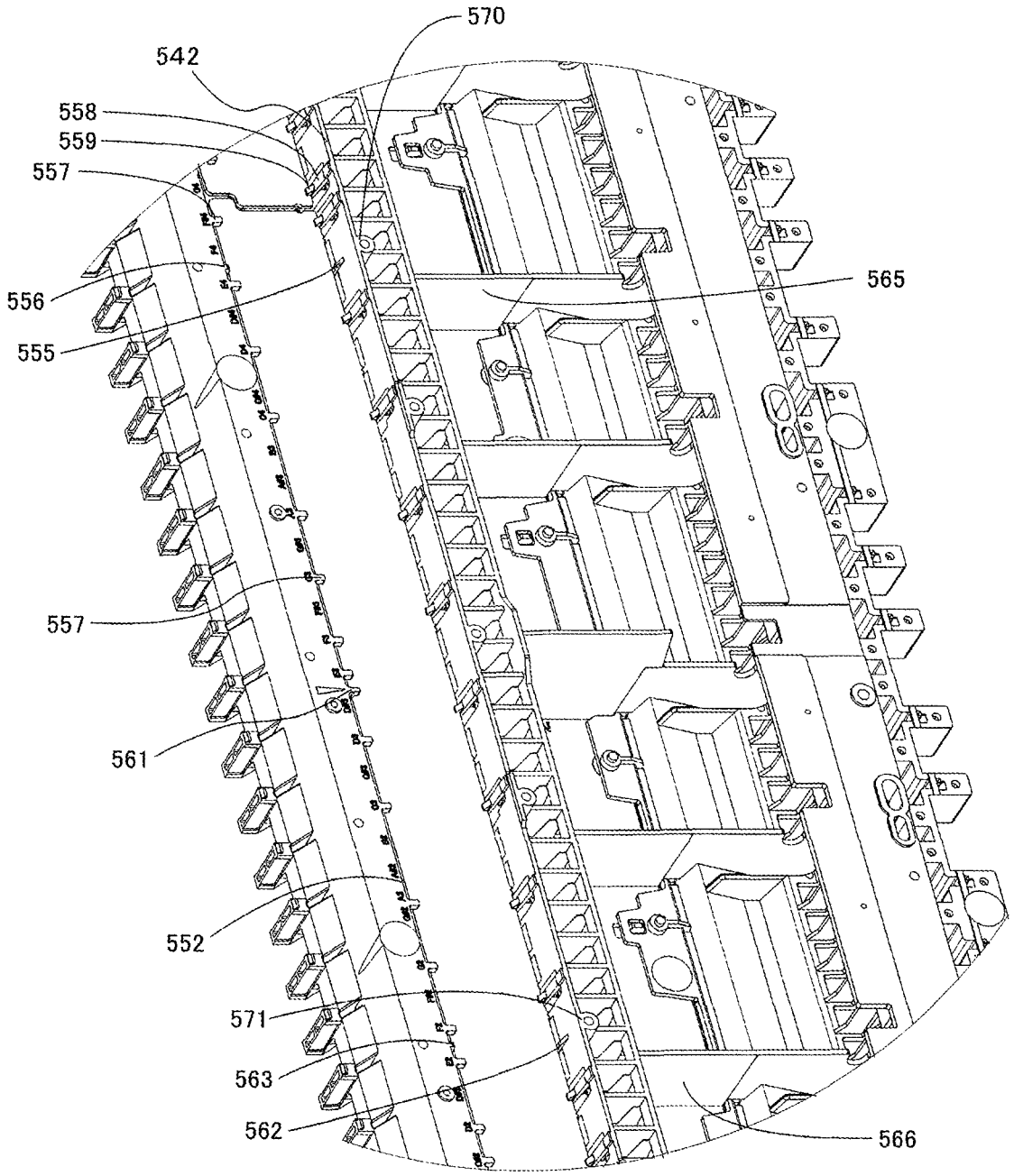
FIG. 8 is a perspective view showing a detailed structure of the frame according to one embodiment of the present invention.

FIG. 8 shows a perspective view of the frame 500 seen from the lower left. The frame 500 includes a plurality of pairs of holding portion 555 and holding portion 556. In FIG. 8, the holding portion 555 and the holding portion 556 form a pair, and the holding portion 562 and the holding portion 563 form a pair.

In FIG. 8, at least one of the holding portion 562 and the holding portion 563 is integrated (integrally molded) with the rib 566. The holding portion 562 is arranged on an extended line in the longitudinal direction of the rib 566. The holding portion 563 is arranged on the extended line in the longitudinal direction of the rib 566 and at a position facing the holding portion 562. However, similar to the holding portion 555 and the holding portion 556, at least one of the holding portion 562 and the holding portion 563 merely needs to be arranged on the extended line in the longitudinal direction of the rib 566. If at least one of the holding portion 562 and the holding portion 563 is arranged on the extended line in the longitudinal direction of the rib 566, the positioning accuracy of the circuit substrate 400 with respect to the front and back direction can be enhanced after fitting the circuit substrate 400.

Figure 9:
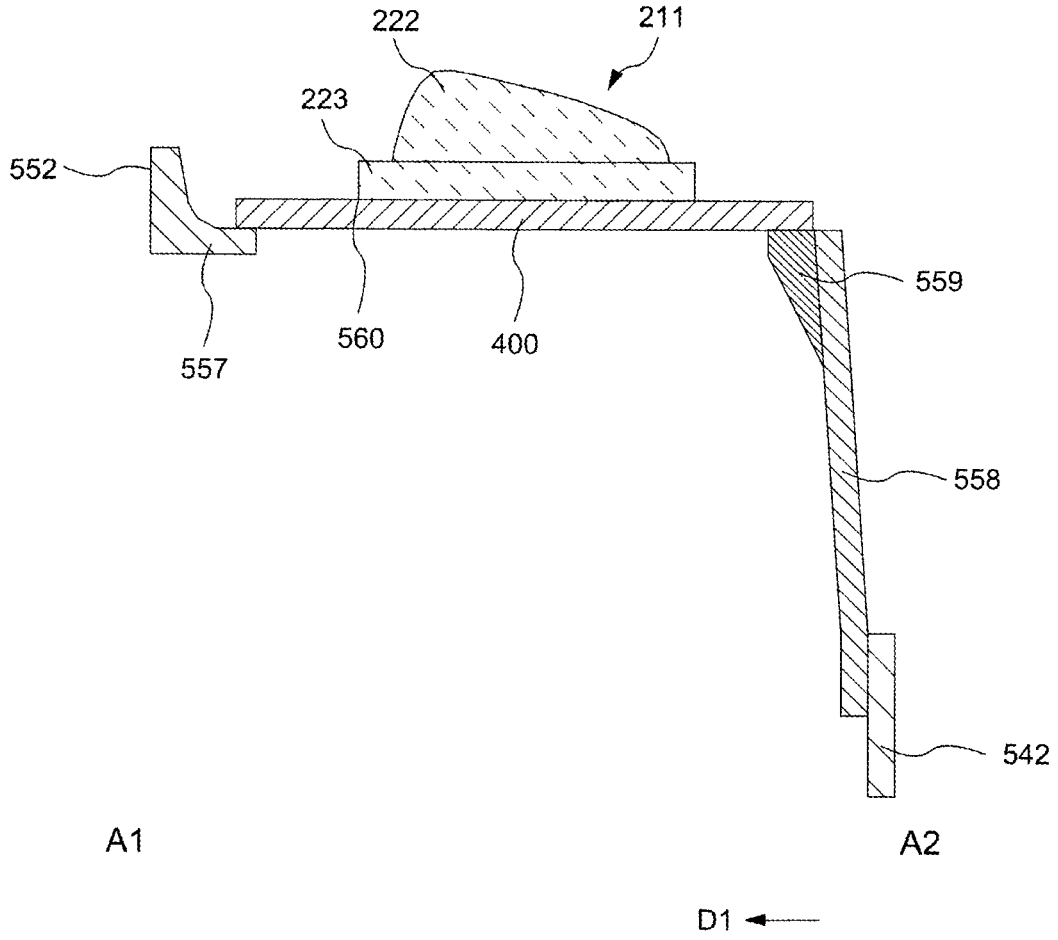
FIG. 9 is a cross-sectional view taken along a chain dashed line A1-A2 in FIG. 7.

FIG. 9 shows a cross-sectional view taken along a chain dashed line A1-A2 in FIG. 7. In FIG. 9, the keyboard assembly 10 (not shown) is arranged on the upper side. In FIG. 9, the A1 side is the front side of the keyboard assembly 10, and the A2 side is the back side of the keyboard assembly 10. The flexible portion 558 is arranged on the wall portion 542. The locking portion 559 is connected to the flexible portion 558. The flexible portion 558 is slightly inclined toward the wall portion 552. In the present embodiment, the wall portion 542, the flexible portion 558, and the locking portion 559 are integrally molded as the frame 500. However, the present invention is not limited to such configuration. The flexible portion 558 and the locking portion 559 may be respectively formed with a different material, and adhered to the wall portion 542.

As shown in FIGS. 8 and 9, the flexible portion 558 is extended along the side wall of the wall portion 542 from one part of the wall portion 542. The flexible portion 558 is bendable toward the first direction D1. When the flexible portion 558 is bended toward the first direction D1 (in particular, direction from A1 to A2), the circuit substrate 400 can be detached/attached. The locking portion 559 is projected from the flexible portion 558 toward the wall portion 552. A fixing portion 557 having a protruding shape is arranged on the wall portion 552. The fixing portion 557 is projected from the wall portion 552 toward the wall portion 542. In FIG. 9, the fixing portion 557 is arranged at a position facing the flexible portion 558 and the locking portion 559. However, the present invention is not limited to such configuration. The fixing portion 557 may be arranged at a position not facing the flexible portion 558 and the locking portion 559.

The circuit substrate 400 is arranged on the fixing portion 557 and the locking portion 559. That is, the fixing portion 557 and the locking portion 559 regulate the circuit substrate 400 from moving toward the lower side.

The rubber switch 211 is arranged on the circuit substrate 400. The rubber switch 211 is arranged in correspondence with each key 100. The rubber switch 211 has the dome shaped bulging portion 222 formed on the rubber sheet 223. The movable contact portion is arranged on the inner side of the bulging portion 222. The movable contact portion is arranged facing the sensor 300 at a distance so as to be in contact with or separated from the sensor 300 (not shown) of the circuit substrate 400. When the bulging portion 222 is pressed by the hammer assembly 200 according to the key depression operation of the key 100, the bulging portion 222 is elastically deformed so that the movable contact portion makes contact with the sensor 300. The note ON is thereby output from the signal converting unit 710 shown in FIG. 2.

Figure 10:
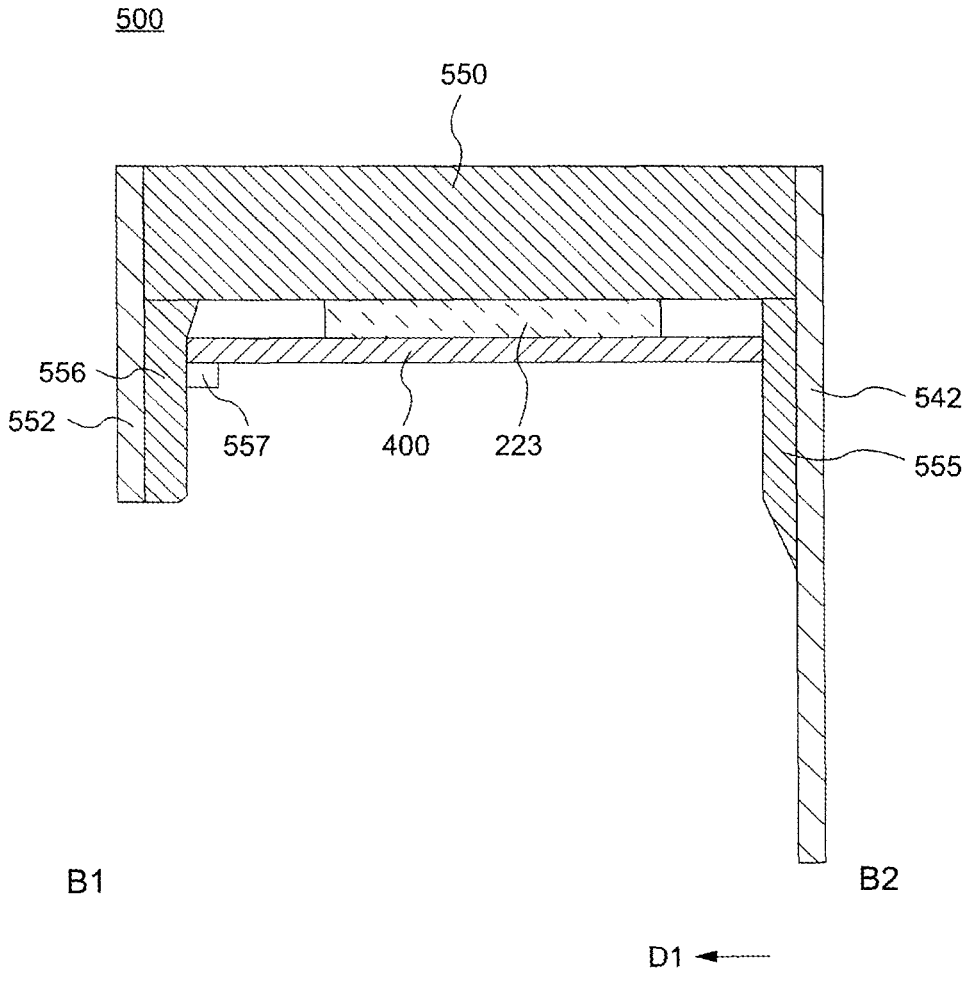
FIG. 10 is a cross-sectional view taken along a chain dashed line B1-B2 in FIG. 7.

FIG. 10 shows a cross-sectional view taken along a chain dashed line B1-B2 in FIG. 7. In FIG. 10, the keyboard assembly 10 is arranged on the upper side. In FIG. 10, the B1 side is the front side of the keyboard assembly 10, and the B2 side is the back side of the keyboard assembly 10. The wall portion 542 and the wall portion 552 are coupled by the rib 550. In other words, the wall portion 542 and the wall portion 552 are connected to the rib 550. The holding portion 555 is arranged on the wall portion 542. The holding portion 556 is arranged on the wall portion 552. The holding portion 555 has an inclination toward the wall portion 552. The holding portion 556 has an inclination toward the wall portion 542. In the present embodiment, the wall portion 542 and the holding portion 555 are integrally formed, and the wall portion 552 and the holding portion 556 are integrally molded. However, the present invention is not limited to such configuration. The holding portion 555 may be formed with a material different from the wall portion 542, and the holding portion 555 may be adhered to the wall portion 542. Similarly, the holding portion 556 may be formed with a material different from the wall portion 552, and the holding portion 556 may be adhered to the wall portion 552.

At the cross-sectional view of the frame 500, the length between the holding portion 555 and the holding portion 556 is substantially the same as the width of the circuit substrate 400. The circuit substrate 400 is held between the holding portion 555 and the holding portion 556. That is, the holding portion 555 and the holding portion 556 fix the position of the circuit substrate 400 in the front and back direction of the frame 500. The upper surface of the circuit substrate 400 is in contact with the rubber sheet 223. The rubber sheet 223 regulates the upward movement of the circuit substrate 400. The rubber sheet 223 is fixed by the circuit substrate 400 and the rib 550.

Next, a method for fitting the circuit substrate 400 in the frame 500 will be described with reference to FIG. 7, and FIGS. 11A to 14B. FIGS. 11A, 12A, 13A, and 14A are cross-sectional views taken along line A1-A2 in FIG. 7. FIGS. 11B, 12B, 13B, and 14B are cross-sectional views taken along line B1-B2 in FIG. 7.

The positioning of the circuit substrate 400 with respect to the left and right is carried out by fitting the concave portion 567 of the circuit substrate 400 to the positioning convex portion 561 arranged on the frame 500 shown in FIG. 6.

Figure 11A:
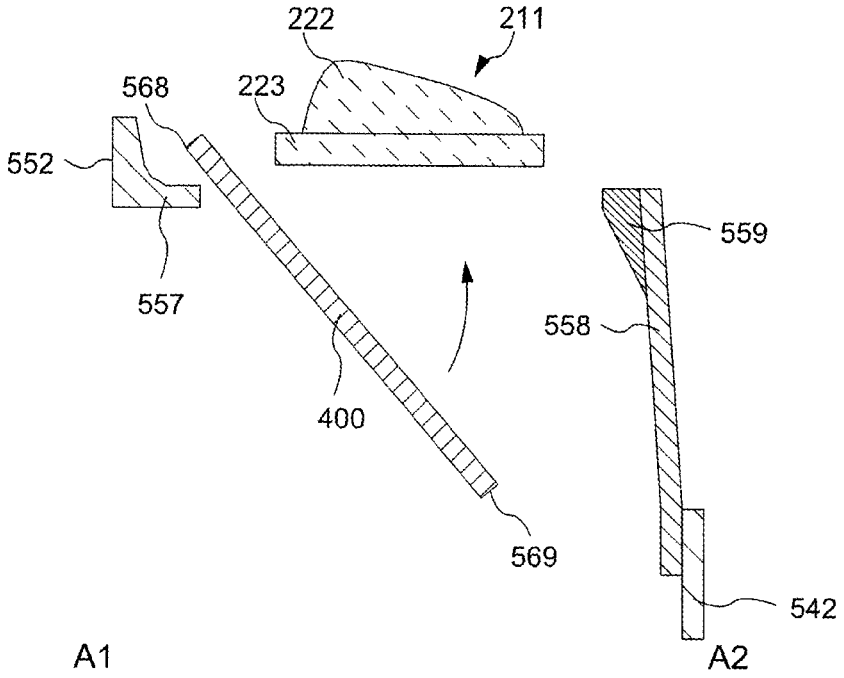
FIG. 11A is a cross-sectional view taken along line A1-A2 showing a method for fitting a circuit substrate to a frame.
Figure 11B:
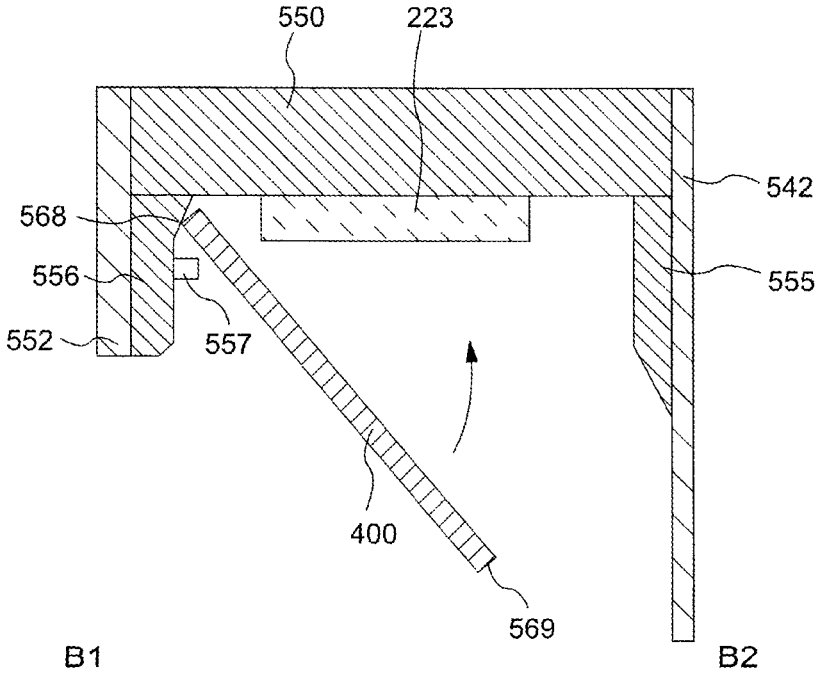
FIG. 11B is a cross-sectional view taken along line B1-B2 showing a method for fitting the circuit substrate to the frame.

As shown in FIG. 11A, a first end 568 of the circuit substrate 400 is inserted to the fixing portion 557 side arranged on the wall portion 552. Then, as shown in FIG. 11B, the first end 568 is abutted against the holding portion 556 from the diagonally lower side. Then, the circuit substrate 400 is rotated with a point of the first end 568 as an axis to push a second end 569 of the circuit substrate 400 up toward the rib 550 from the lower side, as shown in FIGS. 11A and 11B.

Figure 12A:
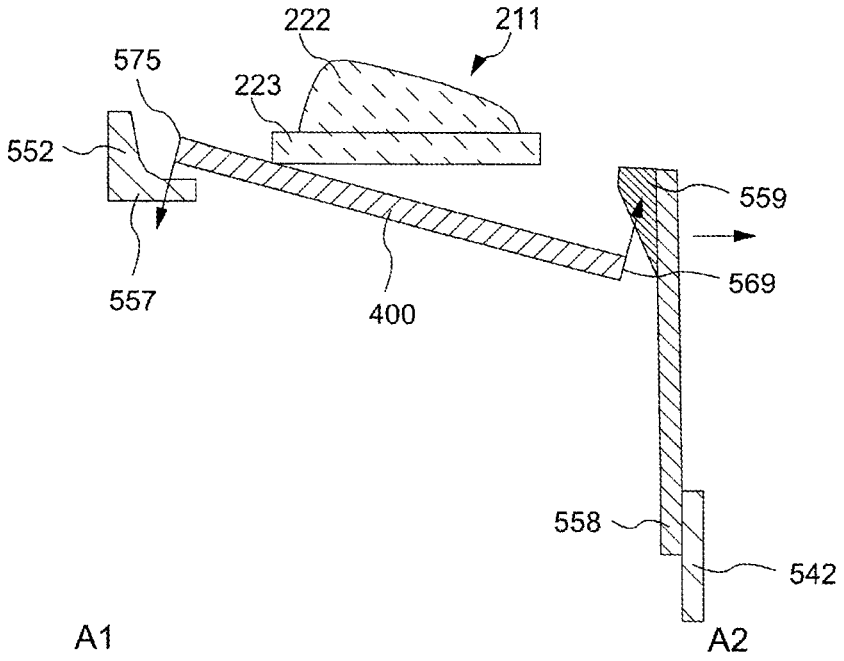
FIG. 12A is a cross-sectional view taken along line A1-A2 showing a method for fitting the circuit substrate to the frame.
Figure 12B:
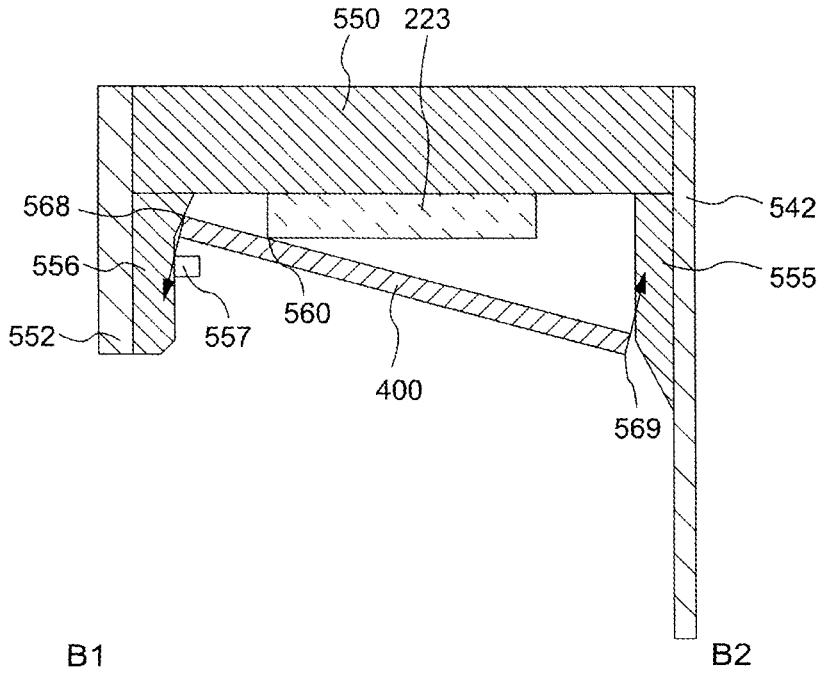
FIG. 12B is a cross-sectional view taken along line B1-B2 showing a method for fitting the circuit substrate to the frame.

Next, as shown in FIG. 12A, when the second end 569 is pushed up toward the upper side, the second end 569 is abutted against an inclined surface of the locking portion 559. When the second end 569 is pushed up toward the rib 550 while the second end 569 is remained abutting against the inclined surface of the locking portion 559, a force is applied in a direction of an arrow on the inclined surface of the locking portion 559 by the second end 569. When the second end 569 is further pushed up toward the rib 550, the flexible portion 558 connected to the locking portion 559 is bended toward the wall portion 542 side. As shown in FIG. 12B, as the circuit substrate 400 is rotated, one end 568 of the circuit substrate 400 is shifted while sliding the inclined surface of the holding portion 556 in a direction of an arrow (lower side). Similarly, the second end 569 is moved in a direction of an arrow (upper side).

Figure 13A:
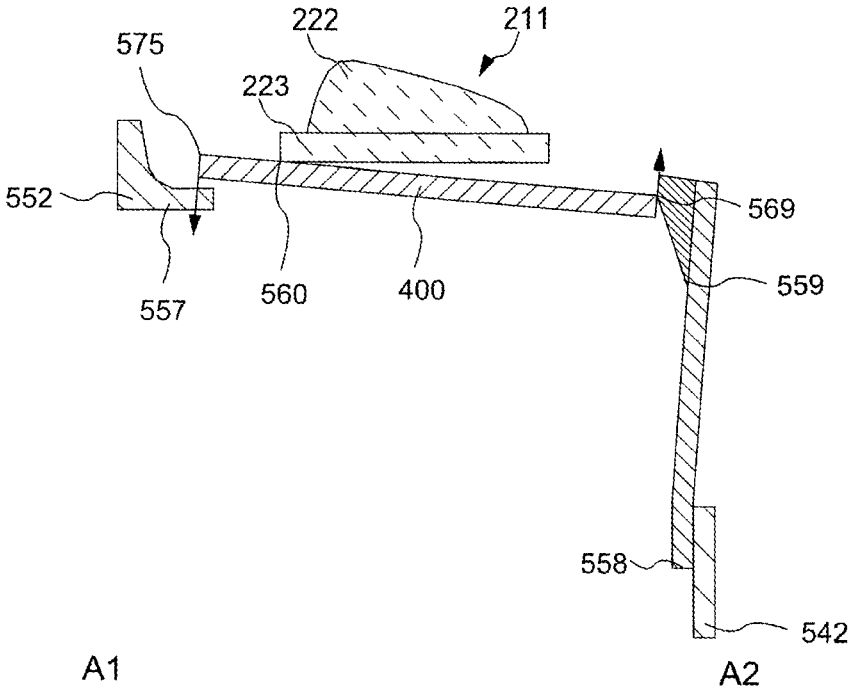
FIG. 13A is a cross-sectional view taken along line A1-A2 showing a method for fitting the circuit substrate to the frame.
Figure 13B:
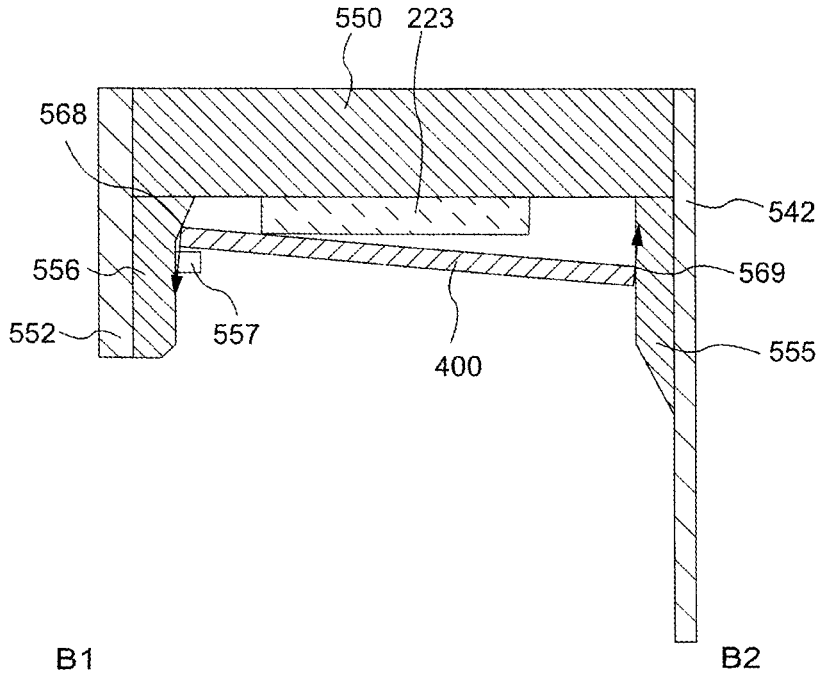
FIG. 13B is a cross-sectional view taken along line B1-B2 showing a method for fitting the circuit substrate to the frame.

As shown in FIG. 13A, when the second end 569 is pushed up toward the rib 550 while the second end 569 is abutted against the inclined surface of the locking portion 559, the circuit substrate 400 is in contact with the end of the rubber sheet 223. With the end of the rubber sheet 223 as a supporting point 560, the circuit substrate 400 is further pushed up toward the rib 550. As shown in FIG. 13B, the first end 568 is shifted while sliding the inclined surface of the holding portion 556 in a direction of an arrow (lower side). Similarly, the second end 569 is moved in a direction of an arrow (upper side).

Figure 14A:
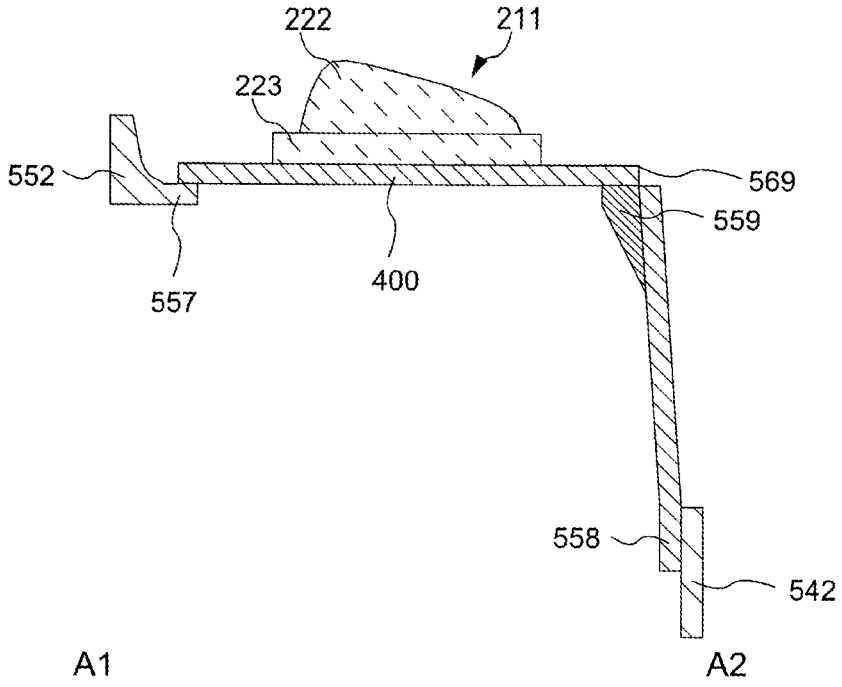
FIG. 14A is a cross-sectional view taken along line A1-A2 showing a method for fitting the circuit substrate to the frame.
Figure 14B:
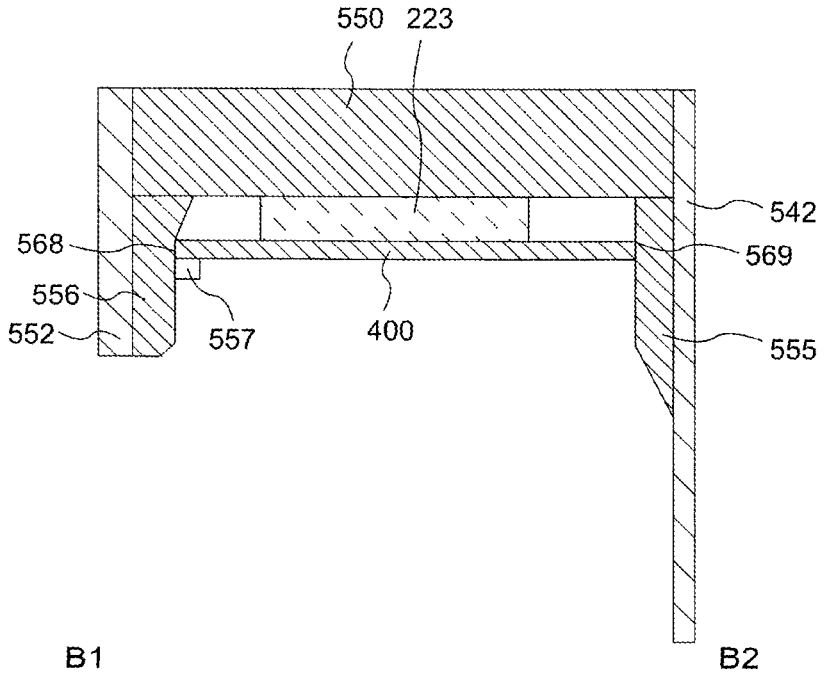
FIG. 14B is a cross-sectional view taken along line B1-B2 showing a method for fitting the circuit substrate to the frame.

As shown in FIG. 14A, when the circuit substrate 400 is further pushed up toward the rib 550 and the circuit substrate 400 goes beyond the locking portion 559, the flexible portion 558 bended toward the wall portion 542 is restored, and returned to the wall portion 552 side. As the locking portion 559 goes under the circuit substrate 400, the circuit substrate 400 is fixed by the locking portion 559. As the locking portion 559 goes under the circuit substrate 400, the circuit substrate 400 is regulated from moving toward the lower side. As shown in FIG. 14B, the circuit substrate 400 is held between the holding portion 555 and the holding portion 556. The circuit substrate 400 is thereby fixed in the front and back direction of the key 100.

In the present embodiment, the holding portion 555 is arranged on the extended line in the longitudinal direction of the rib 565. The holding portion 562 is arranged on the extended line in the longitudinal direction of the rib 566. Furthermore, the wall portion 542 couples the rib 565 and the rib 566. Thus, the rigidity of the wall portion 542 with respect to the backward direction of the frame 500 can be enhanced.

The keyboard apparatus according to the present invention can enhance the positioning accuracy of the circuit substrate 400 with respect to the front and back direction after fitting the circuit substrate 400 since at least one of the holding portion 555 and the holding portion 556 is arranged on the extended line in the longitudinal direction of the rib 565.

The present invention is not limited to the embodiment described above, and can be appropriately modified within a scope not deviating from the gist of the invention.

According to the present invention, the keyboard apparatus in which the positioning accuracy of the switch substrate with respect to the front and back direction is enhanced can be provided.

Although the circuit substrate 400 which is a plate-shaped is shown as the first member, the first member is not limited to the plate-shaped. The first member may be a rigid body like a cuboid shape. The first member is preferably solid. The first member may have a projecting portion instead of that the holding portion 555 (first contacting portion) and the holding portion 556 (second contacting portion) have projecting portions. Or more specifically, the first member, the holding portion 555 (first contacting portion) and the holding portion 556 (second contacting portion) may do not have projecting portions.

REFERENCE SIGNS LIST

1: keyboard apparatus
10: keyboard assembly
51, 53, 55: guide
70: sound generating device
80: speaker
90: housing
100: key
100*b*: black key
100*w*: white key
120: hammer supporting portion
150: concave portion
151, 153: key guide
155: side key guide
180: connecting portion
181: plate-shaped flexible member
183: key side supporting portion
185: rod shaped flexible member
200: hammer assembly
210: front end
211: rubber switch
220: shaft supporting portion
222: bulging portion
223: rubber sheet
230: weight portion
300: sensor

410: lower stopper
430: upper stopper
500: frame
511, 513: frame guide
515: side frame guide
520: rotation shaft
521: distal end frame guide
540, 550, 551, 553, 565, 566: rib
542, 552, 554: wall portion
544: supporting column
555, 556, 562, 563: holding portion
557: fixing portion
558: flexible portion
559: locking portion
561: positioning convex portion
567: concave portion
568: first end
569: second end
585: frame side supporting portion
710: signal converting unit
730: sound source unit
750: output unit
NV: non-appearing portion
PV: appearing portion

What is claimed is:

1. A keyboard apparatus comprising:
a frame; and
a plurality of keys attached to the frame,
wherein the frame includes:
a rigid body having a first side and a second side opposite to the first side;
a first rib having a longitudinal shape extending in a first direction and configured to position the rigid body;
a plurality of sensors arranged on the rigid body, with each sensor arranged in correspondence to one of the plurality of keys and configured to receive a signal when the corresponding key is depressed;
a first holding portion arranged to contact and hold the first side of the rigid body; and
a second holding portion arranged to contact and hold the second side of the rigid body,
wherein the first holding portion is arranged along a line extending in the first direction from the first rib.

2. The keyboard apparatus according to claim 1,
wherein the frame further includes:
a second rib at a position different from the first rib, the second rib having longitudinal shape in the first direction; and
a first wall portion having longitudinal shape in a second direction intersecting the first direction, and
wherein the first wall portion is connected to the first rib and the second rib.

3. The keyboard apparatus according to claim 2,
wherein the frame further includes a second wall portion facing the first wall portion.

4. The keyboard apparatus according to claim 1,
wherein the first rib is integrally molded with at least one of the first holding portion and the second holding portion.

5. The keyboard apparatus according to claim 1,
wherein the second holding portion is arranged in the first direction with respect to the first rib, and faces the first holding portion.

6. The keyboard apparatus according to claim 1,
wherein the first holding portion forms a pair with the second holding portion, and
wherein the frame includes a plurality of pairs of the first holding portion and the second holding portion.

7. The keyboard apparatus according to claim 1,
wherein the first holding portion has a shape projecting toward the second holding portion, and
wherein the second holding portion has a shape projecting toward the first holding portion.

8. The keyboard apparatus according to claim 1,
wherein the rigid body is a plate-shaped member.

9. The keyboard apparatus according to claim 1,
wherein the first direction is a direction parallel to a longitudinal direction of a key of the plurality of keys.

10. The keyboard apparatus according to claim 3,
wherein the second wall portion has a longitudinal shape in the second direction.

11. The keyboard apparatus according to claim 3,
wherein the frame further includes a first contacting portion projecting from the second wall portion toward the first wall portion, and being in contact with the rigid body from a lower side of the rigid body.

12. The keyboard apparatus according to claim 3,
wherein the frame further includes:
an extending portion arranged on the first wall portion and being bendable toward the first direction; and
a second contacting portion projecting from the extending portion toward the second wall portion and being in contact with the rigid body from a lower side of the rigid body.

13. The keyboard apparatus according to claim 12,
wherein the extending portion is arranged at a position different from the first rib in the second direction.

14. The keyboard apparatus according to claim 1,
further comprising a plurality of hammer assemblies,
wherein the first rib is arranged between a first hammer assembly and a second hammer assembly of the plurality of hammer assemblies.

15. The keyboard apparatus according to claim 14,
wherein the second rib is arranged between a third hammer assembly and a fourth hammer assembly of the plurality of hammer assemblies.

16. The keyboard apparatus according to claim 1,
wherein the rigid body is a circuit substrate.

* * * * *